United States Patent [19]

Watkin et al.

[11] Patent Number: 4,908,998

[45] Date of Patent: Mar. 20, 1990

[54] BLAST CHAMBER

[75] Inventors: Robert B. Watkin; Ronald G. Barrier, both of Peachtree City, Ga.

[73] Assignee: Wheelabrator Corp., Shenandoah, Ga.

[21] Appl. No.: 271,586

[22] Filed: Nov. 14, 1988

[51] Int. Cl.[4] ..... B24C 9/00

[52] U.S. Cl. ..... 51/426; 51/410; 248/297.3; 248/558

[58] Field of Search ..... 51/426, 410, 424, 425, 51/431–434, 429; 248/285, 286, 297.3, 558

[56] References Cited

U.S. PATENT DOCUMENTS

| | | | |
|---|---|---|---|
| 3,015,913 | 1/1962 | Anderson, Sr. | 51/431 |
| 3,020,015 | 2/1962 | Seplavy | 248/286 |
| 3,604,157 | 9/1971 | Fogle | 51/426 |
| 3,951,092 | 4/1976 | van den Broek | 51/415 |
| 4,064,656 | 12/1977 | Zeidler | 51/431 |
| 4,269,003 | 5/1981 | Wolfgang | 51/426 |
| 4,680,899 | 7/1987 | Carpenter | 51/429 |

FOREIGN PATENT DOCUMENTS

| | | | |
|---|---|---|---|
| 7902858 | 10/1980 | Netherlands | 51/410 |

*Primary Examiner*—Robert Rose

*Attorney, Agent, or Firm*—Rockey and Rifkin

[57] ABSTRACT

A blast chamber contains a plurality of rotatable vertically disposed members with numerous holes therealong. Slidable brackets or yoke assemblies are secured to the vertical members at desired positions. in turn, blast wheels are secured to the mounting brackets. A large number of horizontal, vertical, and angular positions for each blast wheel results and permits the blast treatment of an object of almost any shape.

6 Claims, 3 Drawing Sheets

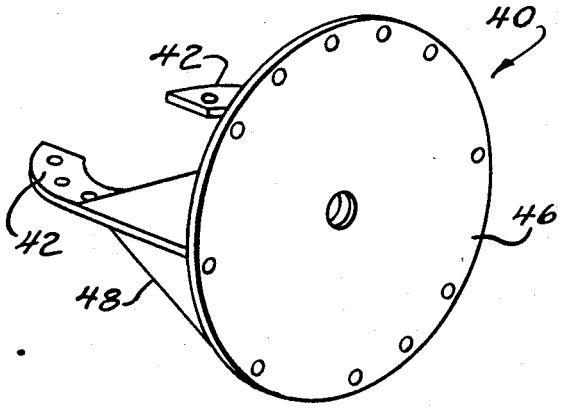
FIG. 5
FIG. 4
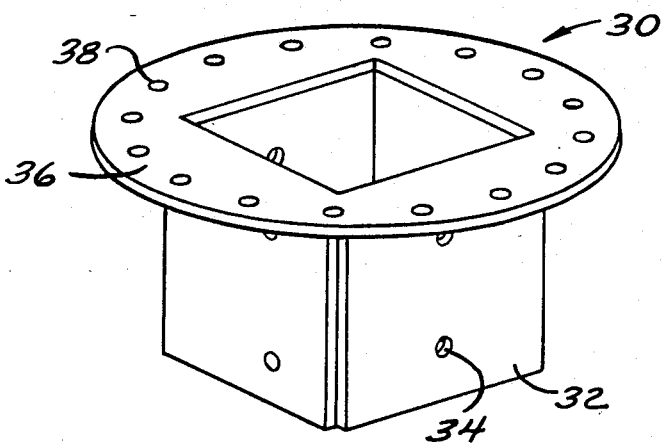

BLAST CHAMBER

BACKGROUND OF THE INVENTION

This invention relates to chambers or cabinets used in the particulate treatment of manufactured parts. More specifically, it relates to chambers that incorporate blast wheels or other particulate projection devices for the surface treatment of parts to clean, abrade, finish or otherwise prepare the parts for their intended use. Usually such treatment devices employ an abrasive such as sand, steel shot, or steel grit projected against the parts at high velocities to create high impact energy. Thus, for example, cast parts can be deburred, peened or cleaned. In some cases the material at the surface of the part is cold hardened by the treatment.

Typically, the treatment operations are accomplished by the use of an airless centrifugal blasting wheel which will project the particulate against the parts to be treated. In such an operation it is usually necessary, for the protection of personnel and for efficiency, to conduct the treating operations in a closed blast cabinet or chamber. This facilitates recovery and reuse of the particulate and protects personnel from injury.

The blast wheels usually employed to project the particulate consist of a pair of spaced parallel side plates having a number of blades extending radially between the plates in equal angular spacing, with means securing the blades between the plates. Means are provided for rotating the bladed wheel at high speed about a central axis and for depositing particulate material onto the inner end portions of the blades. The particulate material is then displaced by centrifugal force outwardly over the surface of the blades and projected at high velocity from the ends of the blades. Means, such as an impeller, is provided in the central opening for feeding the particulate material onto the inner ends of the blades, with a stationary but adjustable control cage surrounding the impeller for controlling the passage of particulate material to the blades. The control cage determines the direction as well as the blast pattern of the particulate material thrown from the ends of the blades.

Cast parts, such as those used in the automotive industry, are uniquely and oddly shaped. Consequently, past practice in the industry has been to design a distinct blast chamber for each new part, with the blast wheels permanently positioned to conform to the optimal surface treatment requirements of the part. This practice is costly and requires additional expense each time a design change in the part to be treated occurs. Thus, a need exists for a blast chamber that is easily adjusted and reconfigured to work on cast parts of various shapes and dimensions.

SUMMARY OF THE INVENTION

The present invention meets the need for such an adaptable blast chamber. It provides numerous and overlapping degrees of freedom so that a plurality of blast wheels can be adjusted to different heights, horizontal spacings, and angles. Thus, a cast part of virtually any size or shape can be treated by the present invention.

The novel blast chamber claimed herein includes a chamber or cabinet in which the blast operations are performed. The device also includes a plurality of projection means, such as blast wheels, for projecting the particulate. The blast wheels are adjustably supported at selectable locations on a support means that is itself adjustably disposed within the chamber. Also included are means for providing the particulate to the blast wheels and means for removing the particulate from the blast chamber.

BRIEF DESCRIPTION OF THE DRAWINGS

FIGS. 4–5 are perspective views of the bracket or yoke assembly for mounting the blast wheels.

DETAILED DESCRIPTION OF THE PREFERRED EMBODIMENTS

Figure 1:
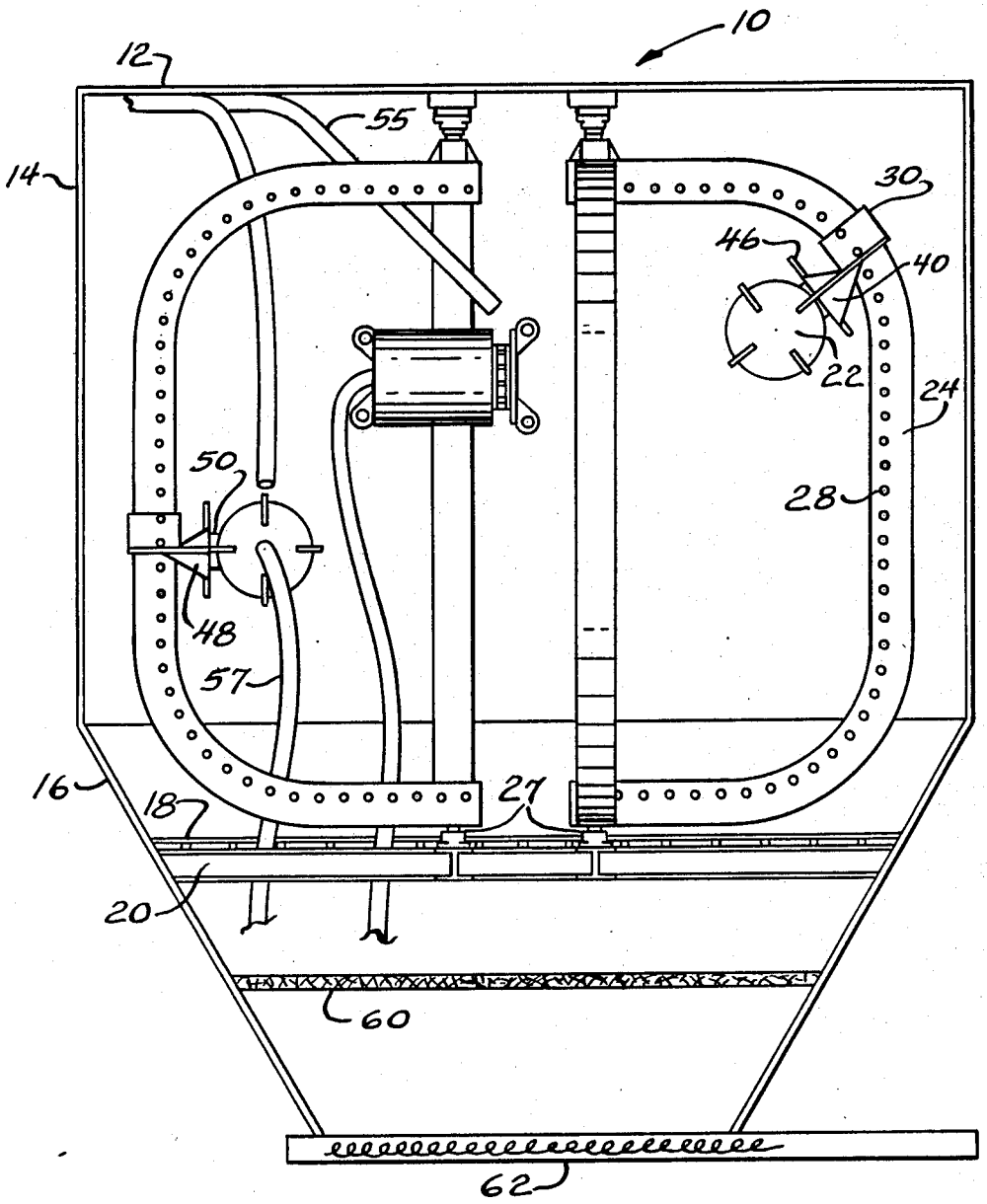
FIG. 1 is a vertical section of the interior of the blast chamber.
Figure 3:
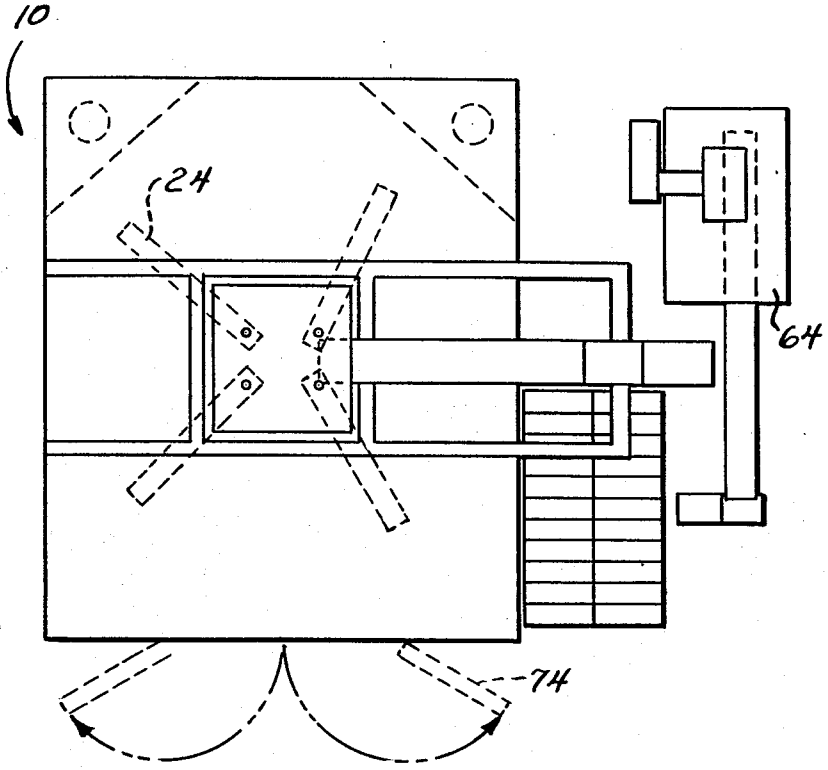
FIG. 3 is a plan view of the top of the blast chamber.

FIG. 1 depicts the general configuration of a blast chamber generally designed as 10. The chamber 10 has a horizontal roof 12, vertical walls 14, and a bottom, hopper-shaped portion 16. The skin of the structure is typically made of steel plate as is known by those in the art. The inner surface of the chamber may be reinforced or lined to better resist the blast treatment. Ease of movement inside the chamber 10 is facilitated by a bar-grate floor 18 that sits on horizontal beams 20 fixed across the width of hopper 16. Particulate projecting means such as blast wheels 22 are mounted at various positions within the chamber 10, depending upon the requirements of the object (not shown) to be treated by particulate matter.

The blast wheels 22 are indirectly supported by vertical members 24 that are rotatably mounted on pivot pedestals 26 and 27 at the top and bottom of chamber 10. FIG. 1 illustrates four members at 90 degree angles. Each vertical member 24 is preferably fabricated with numerous pairs of parallel holes 28. The blast wheels are mounted on yoke assemblies that are preferably comprised of two brackets that are adjustable with respect to each other. A first bracket 30 (FIG. 4) contains an annular portion 32 designed to slide over the outside of member 24. Holes 34 in bracket 30 align with holes 28 so that the bracket can be secured—by a bolt or pin, for example—at any location along the length of a vertical member. The bracket 30 also includes a flange 36 (FIG. 4) with holes 38. The flange 36 remains transverse to vertical member 24 as the bracket slides therealong.

A second bracket 40 (FIG. 5) is used to secure a blast wheel to the bracket 30. The second bracket is bolted or pinned through holes 42 that align with holes 38 of the bracket flange 36. Because of the matching circular pattern of bolt holes, the angular relationships at which bracket 40 and flange 38 can be secured to each other are limited only by the number of holes. The result is that face plate 46 to which the blast wheels are secured can effectively be rotated 360 degrees around the central axis of vertical member 24. Gussets 48 reinforce the connection of the face plate 46 to plate 44.

Each blast wheel 22 has a mounting plate 50 that bolts to face plate 46 of the second bracket 40. Ideally the mounting plate 50 has holes that provide a blast wheel with angular adjustment relative to a transverse axis through the center of face plate 46.

The preceding discussion highlights the extraordinary versatility of the present chamber. Each of four C-shaped vertical members 24 is rotatable about a vertical axis. Each bracket 30 can be fixed at numerous positions along the entire length of member 24. Moreover, each mounting bracket 40 is angularly adjustable for a full 360 degrees with respect to the bracket 30. This combination permits a blast wheel to project particulates from virtually any vertical, horizontal, or angular location. Furthermore, the control cage that is part of the blast wheel adds an additional angular degree of freedom in controlling the projection of the particulates.

Figure 2:
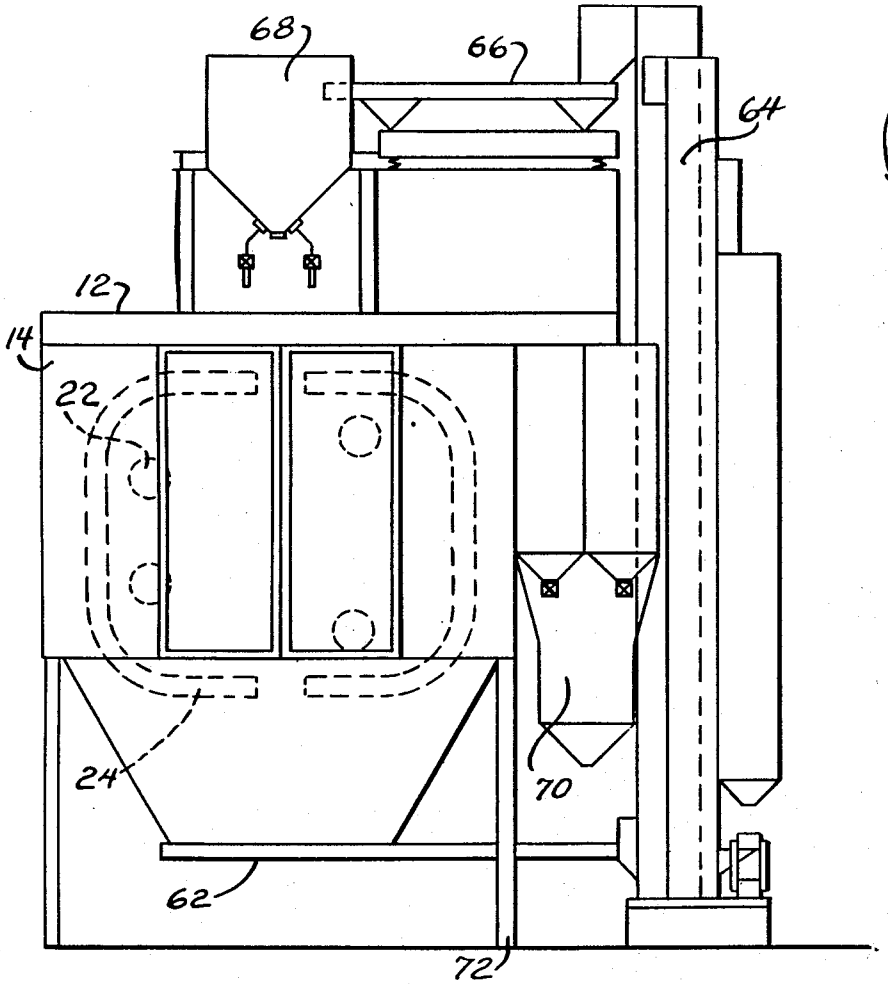
FIG. 2 is a vertical section of the exterior of the blast chamber and appurtenant structures.

Abrasive supply tubes 55 feed the particulate to the blast wheels 22. Electrical power is supplied to the blast wheels by cables 57 that are protected from the particulate by heavy cable insulation. When the chamber 10 is in operation, spent particulate falls through the bargrate floor 18. Large particles (contaminants) are caught by screen 60, while the particulate to be reused for further treating is carried from the chamber by a conveyor 62. In most chambers, there is typically a device at the bottom, such as a blower, for removing very fine particles before they become mingled with the particulate that is recycled for further use.

conveyor 62 leads to a belt and bucket elevator 64 (FIG. 2). The material is then transferred by a shaker feed 66 to an upper distribution bin 68. In practice, several bins may be provided, each holding a different size particulate material. In this manner, the chamber can be used for different types of surface treatments as well as for different cast parts. As the particulate in the upper bins 68 is lost due to fracture and filtering, it can be replaced with material held in lower storage bins 70.

The chamber itself is supported on legs 72, and access to the chamber is through doors 74. Those skilled in the art will understand that the physical configuration of the chamber can be adapted so that parts can be mechanically transported in and out through openings that can be selectively opened and closed.

Various changes and modifications to the preferred embodiments described herein will be apparent to those skilled in the art. For example, the C-shaped members can be S-shaped or serpentine. Moreover, the members can be slidably mounted in tracks for horizontal rather than vertical movement inside the blast chamber. The number of members is variable and a matter of choice. The members themselves can be made with a circular or even triangular cross section. The shape of the mounting brackets described herein are preferred but are by no means considered limiting. Such changes and modifications can be made without departing from the spirit and scope of the present invention and without diminishing its attendant advantages. It is, therefore, intended that such charges and modifications be covered by the following claims:

What is claimed is:

1. A device for blast treating with particulate matter an object which may have exposed and recessed surfaces comprising:

a chamber having walls, a ceiling and a floor for confining dispersion of the particulate matter;

a plurality of means for projecting the particulate matter at said object;

means disposed in said chamber for supporting and positioning said projecting means at selectable locations within said chamber to permit projection of the particulate at the object from selected directions, said supporting means including a generally vertical member secured to the ceiling and floor of said chamber and rotatable about a vertical axis and a yoke assembly for securing said projecting means to said vertical member, said yoke assembly positionable along said vertical member and permitting positioning of the projecting means at selected positions about vertical and horizontal axes passing through the vertical member;

means for supplying the particulate matter to said projecting means; and means for removing the particulate matter from said chamber.

2. The device of claim 1 wherein there are a plurality of supporting means, each adapted to mount at least one of said projecting means.

3. A device for blast treating with particulate matter objects having exposed and recessed surfaces comprising:

a chamber having wall, a ceiling and a floor for confining the dispersion of the particulate matter;

a plurality of supporting means each adapted to mount at least one blast wheel in a plurality of horizontal and vertical positions, said supporting means comprising a vertically oriented elongated c-shaped member secured to the ceiling and floor of said chamber and disposed in said chamber and a yoke assembly to which said blast wheel is connected, said yoke assembly positionable along said vertically oriented elongated C-shaped member permitting positioning of the blast wheel at selected positions about vertical and horizontal axes passing through the c-shaped member;

means for rotatably fastening each of said supporting means within said chamber for rotation about a vertical axis;

means for supplying particulate matter to said blast wheels; and means for removing the particulate matter from inside of said chamber.

4. The apparatus of claim 3 wherein said yoke assembly is adapted to slide over and be secured at selectable positions on said supporting means.

5. The apparatus of claim 2 wherein said yoke assembly is comprised of two separate members angularly adjustable with respect to each other.

6. A device for blast treating the surface of an object with particulate matter, comprising:

a chamber having walls, a ceiling and a floor for confining the dispersion of the particulate matter;

a plurality of blast wheels disposed in said chamber for projecting the particulate matter;

means for supplying particulate matter to said blast wheels;

means for removing the particulate matter from said chamber;

means for supporting said blast wheels in said chamber, said supporting means including (a) a plurality of vertically disposed members secured to the ceiling and floor of said chamber and rotatably disposed inside said chamber;

(b) a plurality of yoke assemblies, adaptable for movement on and to be secured at selected positions on said vertically disposed members, each assembly adapted for securing one of said blast wheels to said vertically disposed members.

* * * * *